US007649446B2

(12) United States Patent
Miyashita et al.

(10) Patent No.: US 7,649,446 B2
(45) Date of Patent: Jan. 19, 2010

(54) MULTIPURPOSE ENGINE CONTROLLER

(75) Inventors: Kazumi Miyashita, Wako (JP); Kazutomo Nishida, Wako (JP); Toshikazu Nakamura, Wako (JP); Toru Taniguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 296 days.

(21) Appl. No.: 11/698,024

(22) Filed: Jan. 26, 2007

(65) Prior Publication Data

US 2007/0182251 A1 Aug. 9, 2007

(30) Foreign Application Priority Data

Feb. 9, 2006 (JP) ..... 2006-032764
Feb. 27, 2006 (JP) ..... 2006-050998

(51) Int. Cl.
*B60Q 1/00* (2006.01)

(52) U.S. Cl. ..... 340/450.3; 123/351; 123/406.13; 340/450; 701/99; 701/112

(58) Field of Classification Search ..... 340/450.3, 340/450, 438; 123/351, 406.13; 701/99, 701/112; 180/277, 279
See application file for complete search history.

(56) References Cited

U.S. PATENT DOCUMENTS 4,409,832 A * 10/1983 Konjedic et al. ..... 73/292
5,117,218 A * 5/1992 Sasaki et al. ..... 340/450.3
6,198,388 B1 * 3/2001 Chen et al. ..... 340/460
6,239,709 B1 * 5/2001 Dykstra et al. ..... 340/618

FOREIGN PATENT DOCUMENTS

JP 53-44615 11/1978
JP 2004-150374 A 5/2004

* cited by examiner

*Primary Examiner*—Brent Swarthout
(74) *Attorney, Agent, or Firm*—Westerman, Hattori, Daniels & Adrian, LLP

(57) ABSTRACT

A multipurpose engine controller comprises a control unit for switching between supplying and stopping power supplied from an ignition circuit to a spark plug on the basis of two states, i.e., the operating state of the multipurpose engine determined based on a detection signal from the engine speed sensor, and the state of the level of the oil inside the crankcase determined based on a detection signal from the float-type oil level sensor.

4 Claims, 7 Drawing Sheets

10

13
11
21
20
12
23a
23
23b
25
22
Lr
Lu
Nr
MAIN SWITCH
CONTROL UNIT
26
27
24
31
32a
32b
32
33

10
13
11
21
20
12
23a
23
23b
25
Lr
Lu
MAIN SWITCH
CONTROL UNIT
26
27
24
31
32a
32b
32
33

MULTIPURPOSE ENGINE CONTROLLER

FIELD OF THE INVENTION

The present invention relates to a multipurpose engine controller whereby the operation of a multipurpose engine mounted in a work machine is controlled on the basis of an oil level.

BACKGROUND OF THE INVENTION

A method (hereinafter referred to as the "oil reservoir method") in which sliding parts are lubricated by oil pooled in a crankcase is widely used as the lubricating method for an engine. Engines that use the oil reservoir method are mounted in work machines.

In oil-reservoir engines, the pooled quantity of oil, i.e., the oil level, must be at a suitable level for the sliding parts to be smoothly lubricated. Japanese Patent Post-Exam Publication No. 53-44615 (JP-53-44615B) and Japanese Laid-Open Patent Publication No. 2004-150374 (JP-2004-150374A) disclose oil level detectors that detect the oil level.

The oil level detectors disclosed in JP-53-44615B and JP-2004-150374A are mounted in vehicle engines and are provided with a float switch. In these oil level detectors, the float drops in accordance with the reduced oil level when the oil level has decreased to a fixed lower-limit level. Therefore, the reduced level can be detected when the switch senses that the float has dropped.

When the oil level detector disclosed in JP-53-44615B detects that the level has dropped, a lamp, a buzzer, or another warning device emits an alarm.

The oil level detector disclosed in JP-2004-150374A, on the other hand, constantly detects the state of the road surface on which the vehicle is traveling, and stops detecting the oil level when the condition of the road surface is determined to be poor. As used herein, the phrase "poor condition of the road surface" refers to a condition in which the road surface negatively affects oil level detection because the surface of the oil is considerably agitated or sloped.

Specifically, the oil level detector disclosed in JP-2004-150374A emits an alarm when the detector has detected that the oil level has dropped in cases in which (1) the condition of the road surface is good, and temporarily suspends oil level detection to prevent the detector from emitting an alarm in cases in which (2) the condition of the road surface is poor. For this reason, the detector can be prevented from accidentally detecting that the oil level has dropped when the road surface condition is poor.

Some of the engines mounted in work machines are multipurpose engines. Some of the work machines produce severe vibrations, and in some work machines the orientation of the multipurpose engine can be temporarily tilted at a considerable angle. Thus, there are multipurpose engines that are used in harsher environments than those mounted in a vehicle. In spite of this fact, when the oil in the crankcase is sufficiently pooled, sliding parts can still be smoothly lubricated with the oil even if the surface of the oil has considerably fluctuated or has been temporarily set at an angle.

It has been proposed to provide the oil level detectors disclosed in JP-53-44615B and JP-2004-150374A to multipurpose engines used in such harsh environments. However, the oil level detectors disclosed in JP-53-44615B and JP-2004-150374A merely emit an alarm when the oil level has dropped.

In contrast, stopping the engine to more positively respond to the situation in which the oil level has dropped can be considered in order to improve the durability of the engine. Specifically, when oil is insufficient at engine startup, startup is prevented, and when oil is insufficient during engine operation, the engine can be stopped.

In this case, however, an engine in which oil is sufficiently pooled in the crankcase would still stop when the surface of the oil severely and considerably fluctuates during work, or when the oil detector detects that the oil level has dropped when the engine is temporarily tilted. As a result, work would have to be suspended. The work efficiency of a work machine can therefore be improved.

In view of the above, there is a need for a technique that assures the durability of a multipurpose engine mounted in a work machine which produces severe vibrations, or a work machine which performs work temporarily tilted at a considerable angle, and that can improve the work efficiency of a work machine in, which a multipurpose engine is mounted.

SUMMARY OF THE INVENTION

According to an aspect of the present invention, there is provided a multipurpose engine controller for controlling a multipurpose engine, the controller comprising a power generator for generating power via a motive power of the multipurpose engine, an ignition circuit for firing a spark plug using the power generated by the power generator, an engine speed sensor for detecting a speed of the multipurpose engine, a float-type oil level sensor for emitting an oil level drop detection signal when the oil level pooled in the crankcase of the multipurpose engine has dropped to a fixed lower-limit level, and a control unit for controlling the ignition circuit, wherein the control unit determines an operating state of the multipurpose engine on the basis of a detection signal from the engine speed sensor, determines the state of the level of the oil on the basis of a detection signal from the float-type oil level sensor, and controls the ignition circuit so as to supply and stop power to the spark plug on the basis of the operating state of the multipurpose engine and the state of the level of the oil.

For this reason, the engine can be determined to be in a state "prior to startup or during startup" or in a state of "operation (running)"; i.e., the operating state of the multipurpose engine can be reliably detected, by detecting the speed of the multipurpose engine using an engine speed sensor.

When the float-type oil level sensor has detected that the oil level has dropped at startup or during operation of the multipurpose engine, the control unit can control the ignition circuit so that the multipurpose engine is prevented from starting up. The multipurpose engine can be started only when the oil is at a suitable level. When the multipurpose engine has started, the sliding parts can be smoothly lubricated by the oil. As a result, the durability of the multipurpose engine can be assured.

On the other hand, when the oil level is adequate, the multipurpose engine is not required to be stopped, even if the surface of the oil severely and considerably fluctuates and temporarily tilts, because oil is sufficiently pooled in the crankcase after the multipurpose engine has been started. Therefore, the work efficiency of the work machine in which a multipurpose engine is mounted can be improved.

Thus, the operating state of the multipurpose engine and the state of the oil level are determined based on two detection signals, i.e., the speed signal of the multipurpose engine and the oil level drop signal, and a multipurpose engine can be easily and reliably started and stopped based on the operating state of the multipurpose engine and the state of the oil level.

Preferably, the control unit determines that the multipurpose engine is operating when a condition has been satisfied that the speed of the multipurpose engine has reached a constant reference speed, and controls the ignition circuit so that power supply to the spark plug is continued regardless of the state of the level of the oil.

Desirably, the multipurpose engine furthermore comprises a starter; and the control unit preferably controls the ignition circuit so as to prevent power from being supplied to the spark plug when a condition has been satisfied that the oil level drop detection signal has been received at a point at which the startup operation of the starter begins.

In a preferred form, the control unit furthermore controls the ignition circuit so as to stop power supply to the spark plug when, after power supply to the spark plug has started, a condition is satisfied that the speed of the multipurpose engine has reached a constant reference speed, and a condition is satisfied that the oil level drop detection signal has been received.

BRIEF DESCRIPTION OF THE DRAWINGS

Certain preferred embodiments of the present invention will be described in detail below, by way of example only, with reference to the accompanying drawings, in which.

DESCRIPTION OF THE PREFERRED EMBODIMENTS

Figure 1:
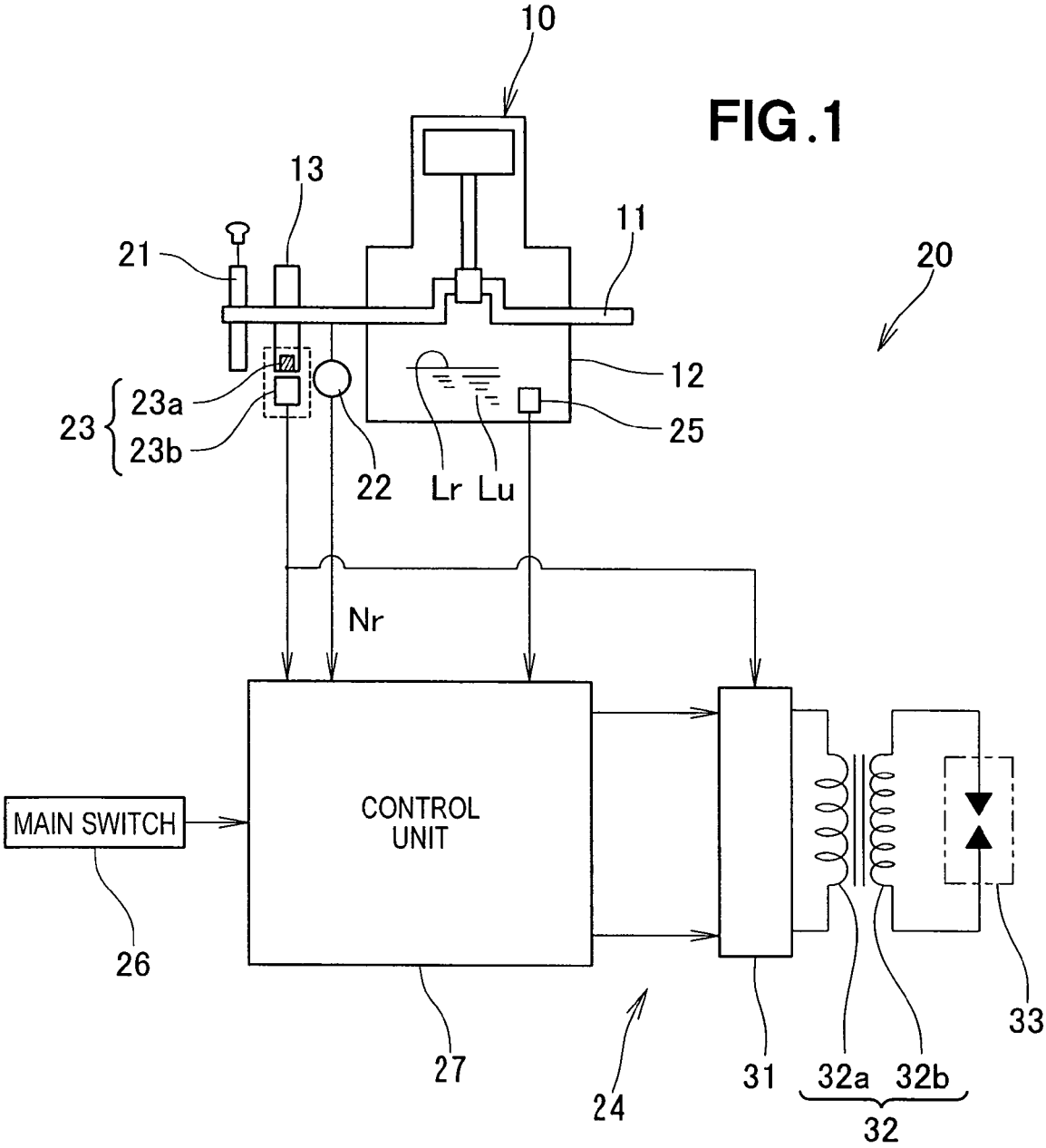
FIG. 1 is a schematic view of the multipurpose engine and multipurpose engine controller of the present invention.

An engine 10 comprises a substantially horizontal crankshaft 11, a crankcase 12, and a recoil starter 21, and is a single-cylinder multipurpose engine mounted in work machines, as shown in FIG. 1. The engine 10 is lubricated by a method in which the sliding parts are lubricated with oil Lu pooled in the crankcase 12. The operation of the engine 10 is controlled by a multipurpose engine controller 20.

The multipurpose engine controller 20 is provided with an engine speed sensor 22, a generator 23, an ignition device 24, a float-type oil level sensor 25, a main switch 26, and a control unit 27. The multipurpose engine controller 20 is not provided with a battery.

The recoil starter 21 is a starting device that allows an operator to manually start the engine, and is provided to the crankshaft 11 or flywheel 13. The flywheel 13 is directly connected to the crankshaft 11.

The engine speed sensor 22 detects the speed (speed of revolution) of the engine 10, i.e., the speed of the crankshaft 11, and emits a detection signal.

The generator 23 generates power from a portion of the output of the engine 10, and feeds the power to the ignition device 24, the control unit 27, and other electrical equipment. The generator comprises a permanent magnet 23*a* disposed on the flywheel 13, and a coil 23*b* disposed adjacent to the permanent magnet 23*a*, for example.

The ignition device 24 comprises an ignition circuit 31, an ignition coil 32, and a spark plug 33. The ignition device 24 directly uses, as the primary power of the ignition coil 32, the power generated by the generator 23, and does not store the power in a battery. The ignition device is a device (also referred to as a "flywheel magneto ignition device" or a "flywheel magneto") in which power is generated using a permanent magnet.

In other words, the ignition method of the ignition device 24 involves feeding power from the generator 23 to the ignition circuit 31 in accordance with the ignition timing for firing the spark plug 33, and using the power as the primary power of the ignition coil 32. The engine 10 can be made smaller and more lightweight without the need for a battery because such an ignition method is adopted.

The ignition circuit 31 fires the spark plug 33 using the power generated by the generator 23, as described above. The ignition coil 32 has a primary coil 32*a* and a secondary coil 32*b*. More specifically, the ignition circuit 31 generates a high-voltage intermittent electric current in the secondary coil 32*b* by intermittently providing power fed from the generator 23 to the primary coil 32*a*. The intermittent electric current generated in the secondary coil 32*b* is fed to the spark plug 33.

The float-type oil level sensor 25 (oil alert 25) is mounted on the crankcase 12 and detects the level Lr of the oil Lu (lubricating oil Lu) pooled in the crankcase 12. The details of the float-type oil level sensor 25 are described below with reference to FIGS. 2A and 2B.

Figure 2B:
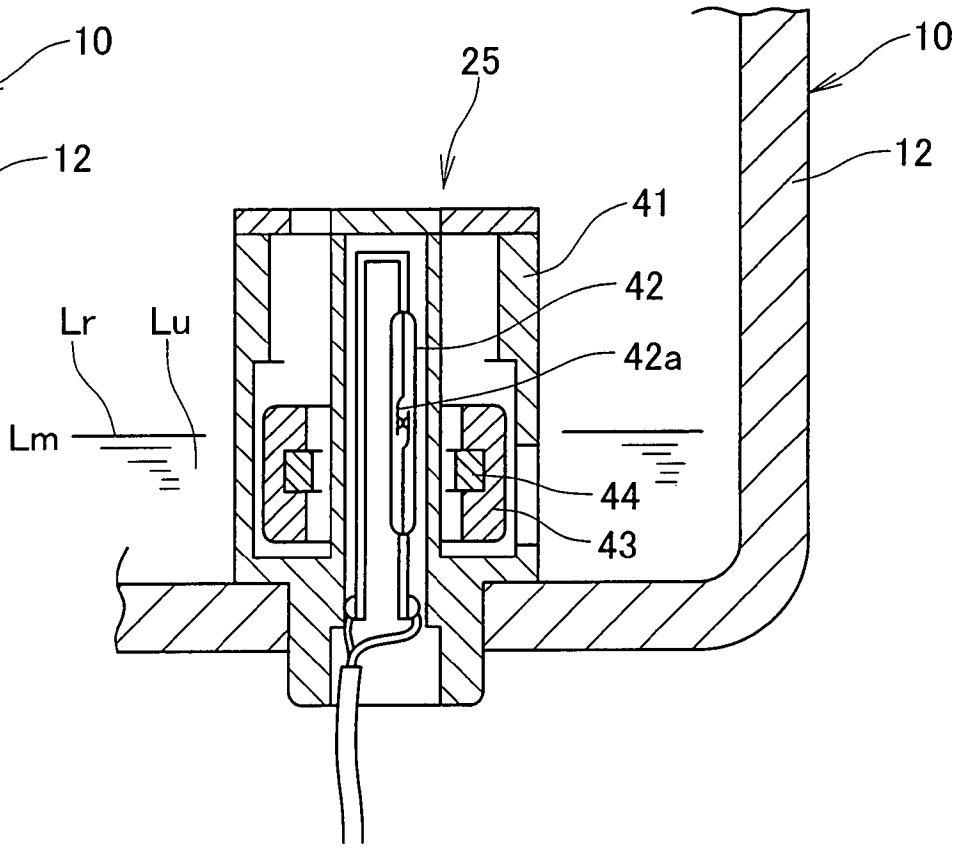
FIGS. 2A and 2B are partial sectional views illustrating the configuration and operation of the float-type oil-level sensor shown in FIG. 1.
Figure 2A:
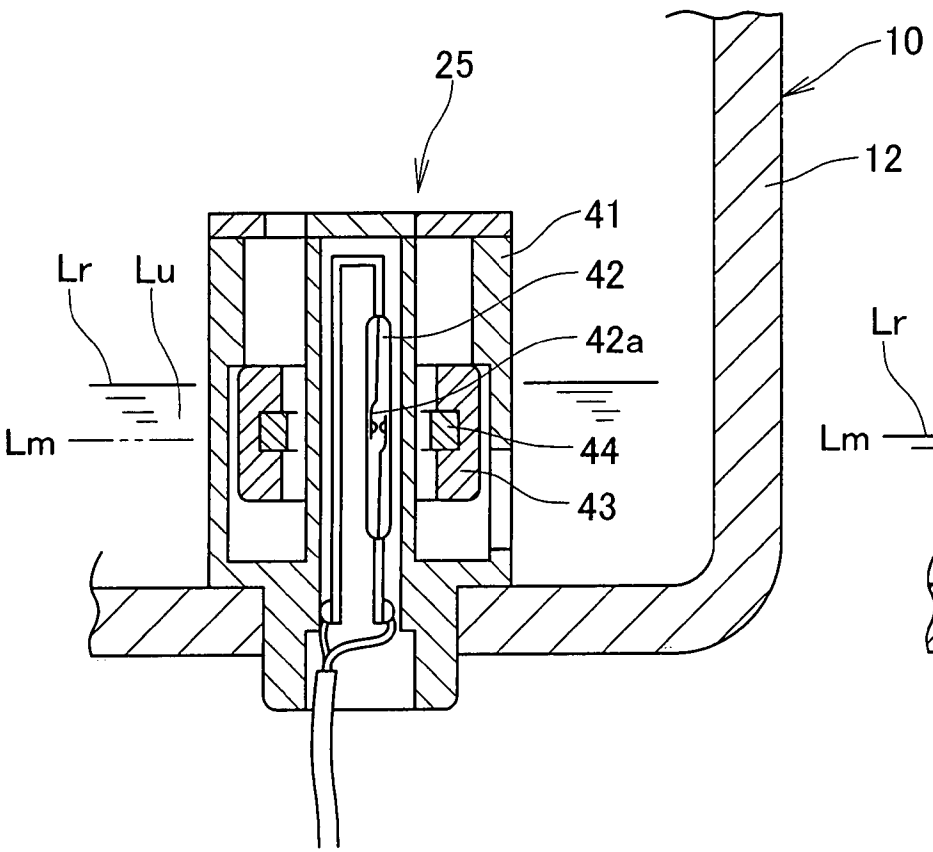

The float-type oil level sensor 25 (hereinafter simply referred to as a "level sensor 25") comprises a case 41, a reed switch 42, and a float 43, as shown in FIG. 2A. The case 41 is mounted inside the crankcase 12. The reed switch 42 and float 43 are housed in the case 41.

The reed switch 42 has a contact point 42*a* (normally open contact point or normally closed contact point) and is substantially vertically disposed.

The float 43 is an annular member that floats on the surface of the oil Lu and moves vertically following the fluctuations of the oil surface, and can move vertically having the reed switch 42 at the center thereof. The internal peripheral surface of the float 43 is provided with an annular permanent magnet 44. The permanent magnet 44 vertically moves together with the float 43 to switch the contact point 42*a* on and off using magnetic force.

The operation of the level sensor 25 is described next.

FIG. 2A shows the state in which the oil Lu is sufficiently pooled above the lower-limit level Lm. In this state, the float 43 floats on the surface of the oil Lu. For this reason, the reed switch 42 is in an off state. Specifically, the level sensor 25 is in an off state.

The float 43 moves down to the lower portion inside the oil Lu in a state in which the surface of the oil Lu has dropped to the lower-limit level Lm, as shown in FIG. 2B. For this reason, the reed switch 42 inverts to an on state. Specifically, the level sensor 25 inverts to an on state and emits a level drop detection signal.

In this manner, the level sensor 25 emits a level drop detection signal when the actual level Lr (height Lr of the oil surface) of the oil Lu has dropped to a preset fixed lower-limit level Lm (i.e., to the level Lm in which the reed switch 42 reverts to an on state).

The main switch 26 comprises a manually operated main power switch for starting and stopping the engine 10 by emitting a switch signal to the control unit 27, as shown in FIG. 1.

The control unit 27 controls the supply of power from the ignition circuit 31 to the spark plug 33 in accordance with the detection signals of the engine speed sensor 22 and the level sensor 25.

Figure 3:
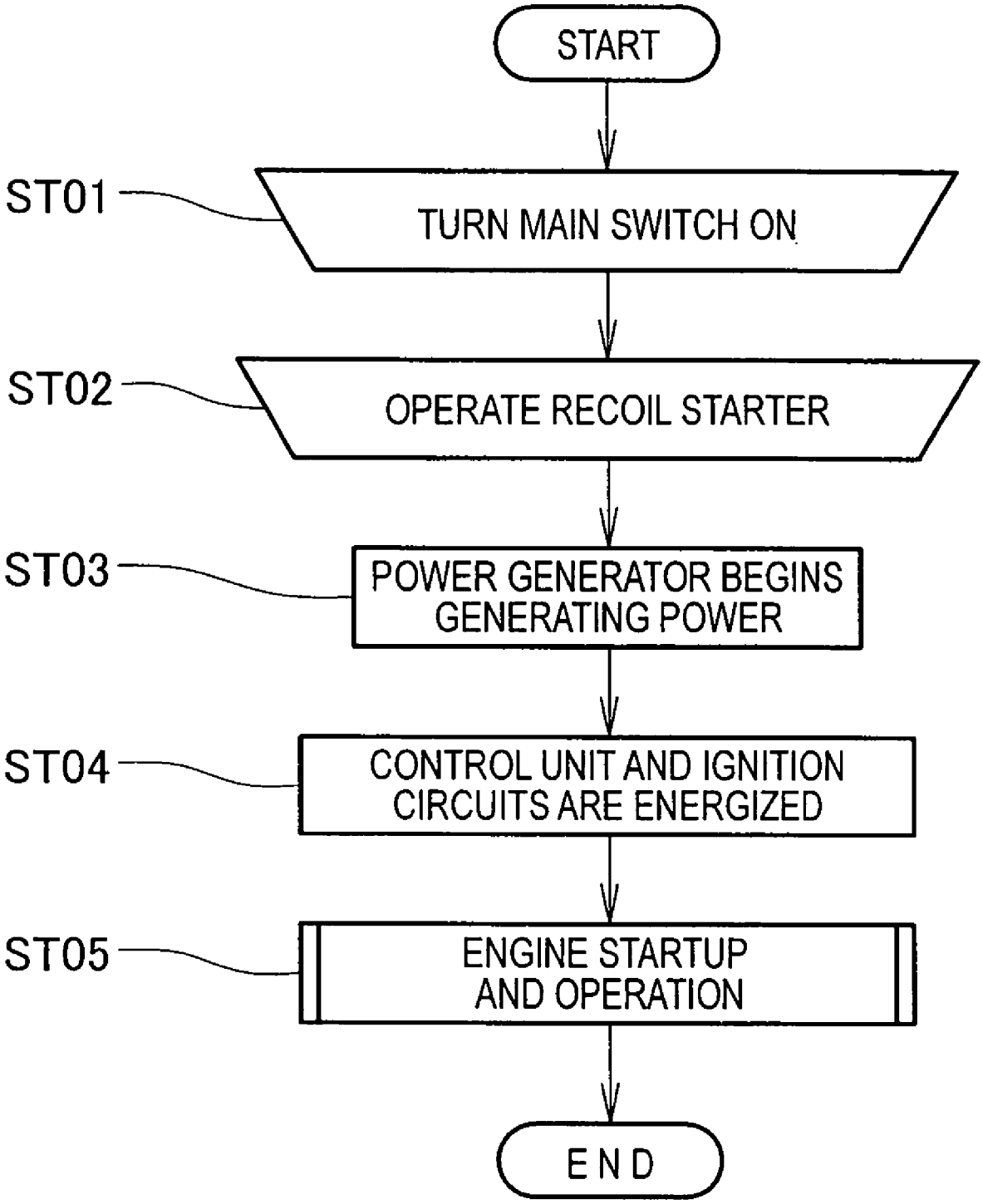
FIG. 3 is a flowchart showing a series of steps beginning with the startup operation of the multipurpose engine shown in FIG. 1 and ending when the control unit executes control routines.
Figure 4:
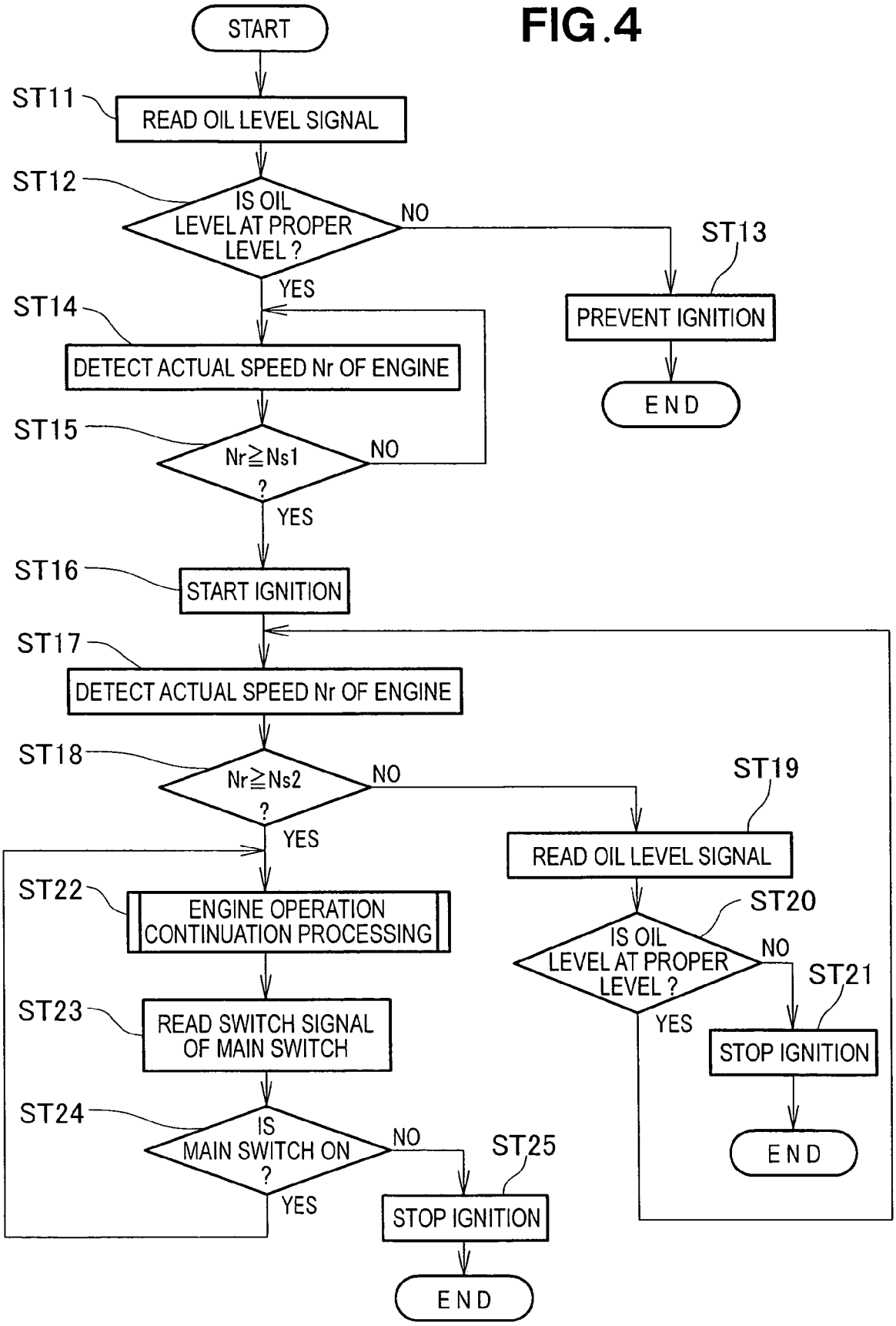
FIG. 4 is a detailed control flowchart for executing the engine startup and operation processing steps shown in FIG. 3.
Figure 5:
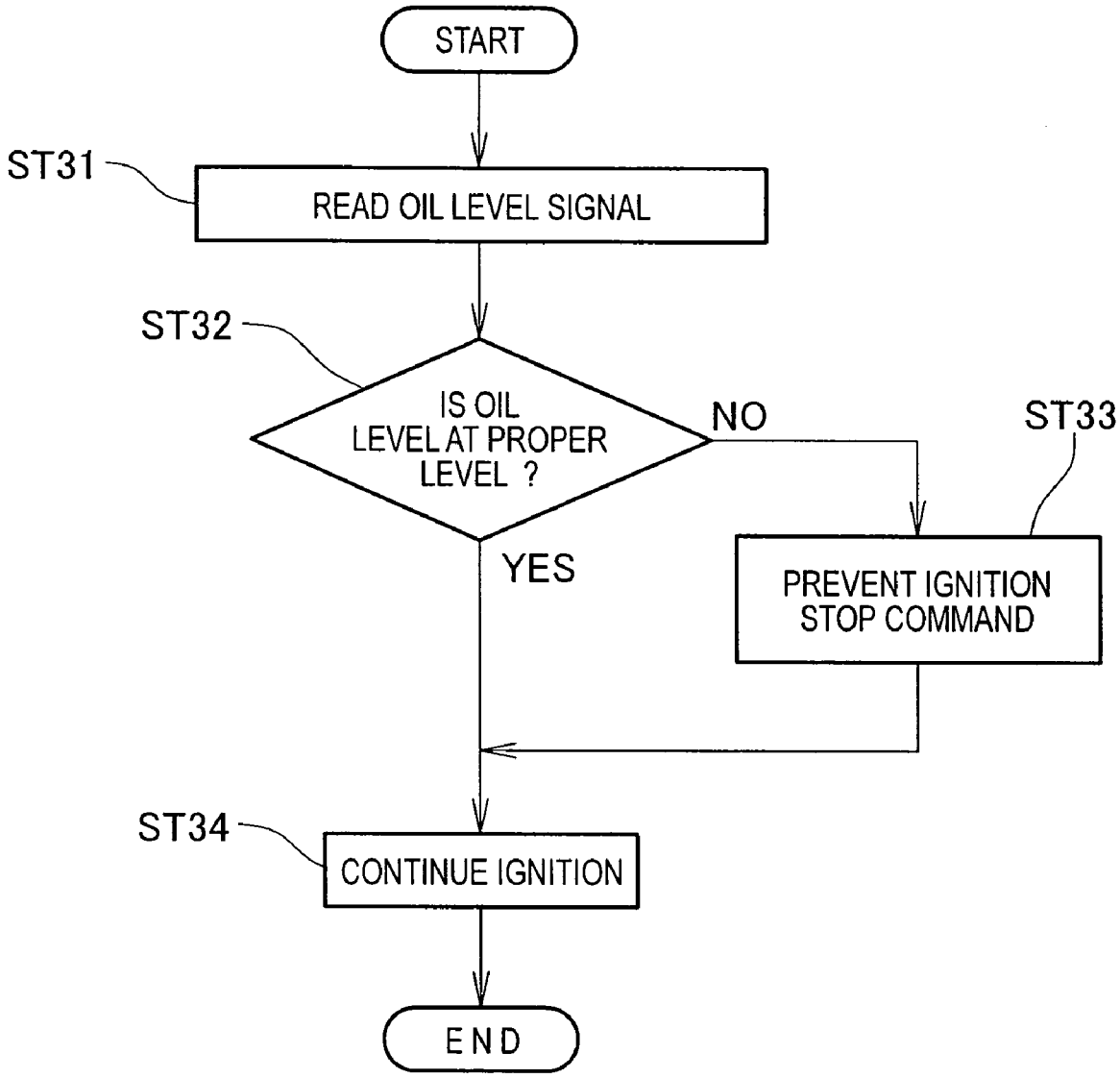
FIG. 5 is a detailed control flowchart for executing the engine operation continuation processing steps shown in FIG. 4.

Described next on the basis of FIGS. 3 to 5 are the control flow and the series of operating routines with reference to FIGS. 1 and 2 for a case in which a microcomputer is used as the control unit 27 shown in FIG. 1.

Described first with reference to FIG. 3 is the series of routines beginning with the startup operation of the engine 10 and ending when the control unit 27 executes the control routines.

Step (hereinafter abbreviated as ST) ST01: The operator switches on the main switch 26.

ST02: With the main switch 26 in the on state, the recoil starter 21 is started when the operator pulls the knob on the recoil starter 21.

ST03: The crankshaft 11 is rotated by the startup operation of the recoil starter 21. As a result, the generator 23 is driven by the crankshaft 11 and begins to generate power.

ST04: The control unit 27 and ignition circuit 31 automatically start when power is fed from the generator 23.

ST05: The control unit 27 automatically executes prescribed engine startup and operation routines. The control flow for executing the engine startup and operation routines is concretely described next with reference to FIG. 4.

FIG. 4 is a control flowchart (main routine) of the control unit 27, showing the basic control flow for executing the "engine startup and operation routines" of step ST05 shown in FIG. 3 described above.

ST11: A detection signal, i.e., an oil level signal, is read from the level sensor 25.

ST12: A determination is made as to whether the actual level Lr of the oil Lu pooled in the crankcase 12, i.e., the oil level Lr, is adequate. When the oil level signal indicates a "low level," a drop in the actual level Lr to the lower-limit level Lm is determined to have occurred, a NO determination is made, and the process advances to ST13. Conversely, when the oil level signal does not indicate a "low level," a YES determination is made, and the process advances to ST 14.

ST13: Since the oil level has been determined to be at the lower limit or less, control based on the control flow is ended after an ignition prevention command has been issued to the ignition circuit 31. In other words, the ignition circuit 31 is instructed to stop feeding power to the spark plug 33. The engine 10 remains stopped because high-voltage electricity is not applied from the ignition coil 32 to the spark plug 33.

ST14: Since the oil level has been determined to be suitable, the speed Nr (hereinafter referred to as the "actual speed Nr") of the engine 10 is detected using the engine speed sensor 22.

ST15: A determination is made as to whether the actual speed Nr has thereafter reached a fixed first reference speed Ns1 set in advance (Nr≧Ns1), due to the increase in the actual speed Nr. If the result of the determination is NO, steps ST14 and ST15 are repeated until a YES determination is obtained; and if the determination is YES, the process advances to ST16. As used herein, the term "first reference speed Ns1" refers to the speed of the engine 10 that is advantageous (stable startup) for beginning an ignition operation by using the spark plug 33 and starting the engine 10. The first reference speed Ns1 is set to about 400 to 600 rpm, for example.

ST16: An ignition start command is issued to the ignition circuit 31. Specifically, the ignition circuit 31 is instructed to feed power to the spark plug 33. The engine 10 starts because high-voltage electricity is applied from the ignition coil 32 to the spark plug 33 as a result.

ST17: The actual speed Nr of the engine 10 is detected again by using the engine speed sensor 22.

ST18: A determination is made as to whether the actual speed has reached a fixed second reference speed Ns2 set in advance (Nr≧Ns2), due to the further increase in the actual speed Nr If the result of the determination is NO, the process advances to ST19; and if the determination is YES, the process advances to ST22. The value of the "second reference speed Ns2" is the minimum speed of the engine 10 that allows stable rotation to be maintained in a no-load condition, for example, and is specifically set to the speed of the idling state. The rotation speed of this idling state is also referred to as the no-load minimum speed or the low-idle speed (hereinafter referred to as the "idling speed"). The second reference speed Ns2 is a larger value than the first reference speed Ns1.

In this manner, when the result of the determination is YES in ST18, the engine 10 has transitioned to a stable operating state because the actual speed Nr has increased to the second reference speed Ns2 (idling speed Ns2). Specifically, a determination is made in ST18 that the engine 10 is currently operating.

ST19: The detection signal, i.e., the oil level signal, of the level sensor 25 is read again because the actual speed Nr has been determined to have not reached the second reference speed Ns2, and a low-speed state has been determined.

ST20: A determination is made as to whether the level Lr is adequate (the same determination as in ST12 described above). If the determination is NO, the process advances to ST21; and if the determination is YES, the process returns to ST17.

ST21: Since the oil level has been determined to be at the lower limit or less, control based on the control flow is ended after an ignition stop command has been issued to the ignition circuit 31. In other words, the ignition circuit 31 is instructed to stop feeding power to the spark plug 33. The engine 10 remains stopped because high-voltage electricity is not applied from the ignition coil 32 to the spark plug 33.

In this manner, steps ST17 and ST20 are repeated until the actual speed Nr increases to the second reference speed Ns2. Conversely, the engine 10 is stopped in ST21 when the oil level Lr has dropped to the lower limit or less.

ST22: Since the engine 10 has been determined to have transitioned to the stable operating state of the idling speed Ns2, a prescribed engine operation continuation routine is performed and the engine 10 continues running (operating). A detailed control flow for executing engine operation continuation routines is described later (see FIG. 5).

ST23: The switch signal of the main switch 26 is read.

ST24: A determination is made as to whether the main switch 26 has remained in an ON state. If the result of the determination is NO, the process advances to ST25; and if the determination is YES, the process returns to ST22. If the operator has switched off the main switch 26, the determination is NO.

ST25: Since the main switch 26 is off, control based on the control flow is ended after an ignition stop command has been issued to the ignition circuit 31. In other words, the ignition circuit 31 is instructed to stop feeding power to the spark plug 33. As a result, the engine 10 remains stopped because high-voltage electricity is not applied from the ignition coil 32 to the spark plug 33.

The operating state of the engine 10 can be continued in this manner by continuing the routine in ST22 until the operator switches of the main switch 26.

FIG. 5 is a control flowchart (subroutine) of the control unit 27, showing the detailed control flow whereby the control unit 27 executes the "engine operation continuation routine" in step ST22 shown in FIG. 4 as described above.

ST31: The detection signal, i.e., the oil level signal, from the level sensor 25 is read.

ST32: A determination is made as to whether the oil level Lr is adequate (the same determination as in ST12 described above). If the determination is NO, the process advances to ST33; and if the determination is YES, the process returns to ST34.

ST33: Since the oil level has been determined to be at the lower limit or less, the ignition stop command is prevented from being transmitted to the ignition circuit 31, and the process advances to ST34. Therefore, the ignition stop command is not issued by the control unit 27 to the ignition circuit 31 even if the oil level is at the lower limit or less.

ST34: The subroutine-based control is ended after the ignition command to the ignition circuit 31 has been continued. Specifically, the engine 10 will continue in a running state (operating state) because the ignition circuit 31 is instructed to continue to feed power to the ignition coil 32.

The group of steps ST32 to ST34 may be configured to continue sending ignition commands to the ignition circuit 31.

From the description above, ST12, ST20, and ST32 clearly constitute "oil level determination procedures" for determining the oil level Lu on the basis of the detection signal of the float-type oil level sensor 25, as shown in FIG. 4 and 5.

ST15 and ST18 in FIG. 4 constitute "engine operating state determination procedures" for determining the operating state of the engine 10 on the basis of the detection signal of the engine speed sensor 22.

ST13, ST16, ST21, ST33, and ST34 constitute an "ignition circuit control procedures" for controlling the ignition circuit 31 so as to switch between feeding and stopping power to the spark plug 33 on the basis of operating state of the engine 10 and the oil level Lu, as shown in FIGS. 4 and 5.

The group of steps ST 1l to ST13 in FIG. 4 constitutes "engine startup prevention procedures" for preventing the engine 10 from starting when the oil Lu is insufficient.

The group of steps ST17 to ST21 in FIG. 4 constitutes "engine stop procedures" for stopping the engine 10 when the oil Lu is insufficient during startup of the engine 10.

ST22 in FIG. 4 constitutes an "engine operation continuation procedure" for continuing the running state of the engine 10 regardless of the actual level Lr of the oil Lu when the engine 10 is running (operating). ST22 may be configured to continue the running state of the engine 10, i.e., continue sending the ignition command to the ignition circuit 31, and is not limited to the subroutine configuration shown in FIG. 5.

Figure 6:
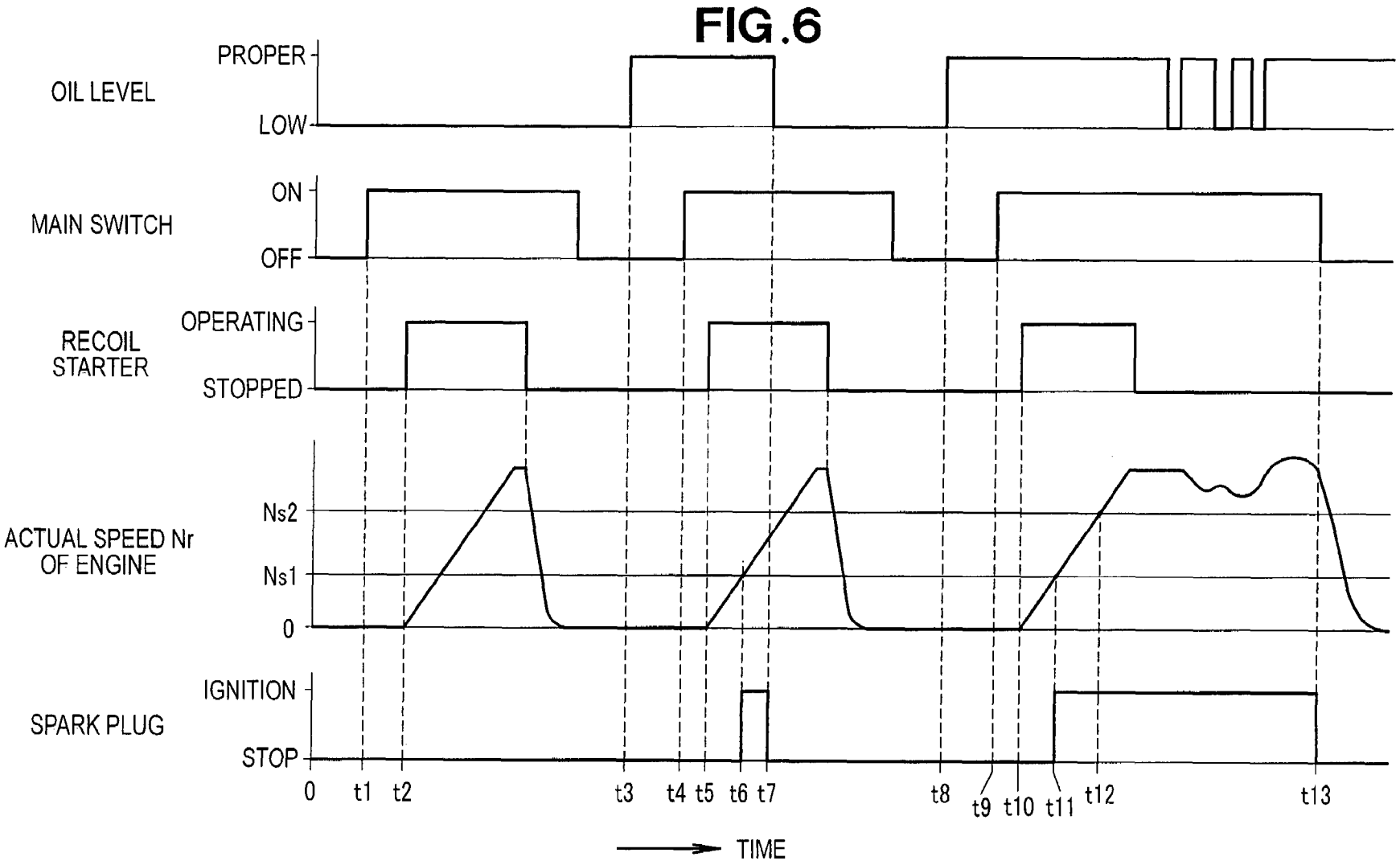
FIG. 6 is a view illustrating an operation of the multipurpose engine controller shown in FIG. 1.

The operation of the multipurpose engine controller 20 described in FIGS. 3 to 5 above is described based on FIG. 6 and with reference to FIG. 1.

FIG. 6 is a timing chart in which time is plotted on the horizontal axis, showing the effect of the components of the multipurpose engine controller 20.

First, the main switch 26 is switched on at time t1 in a state in which the actual level Lr of the oil Lu is reduced (the oil Lu is insufficient). Next, the recoil starter 21 is manually operated to commence startup operation at time t2.

The crankshaft 11 begins to rotate in accordance with the startup operation. As a result, the generator 23 begins to generate power. The control unit 27 and ignition circuit 31 automatically start when power is fed from the generator 23.

However, the spark plug 33 is not fired because the oil Lu is insufficient. The crankshaft 11 stops when the startup operation by the recoil starter 21 is stopped, and the generator 23 also stops as a result. Thus, the engine 10 does not start when the oil Lu is insufficient.

The actual level Lr is thereafter brought to a suitable level at time t3 by filling the crankcase 12 with oil Lu after the main switch 26 has been switched off.

With the engine 10 stopped, the main switch 26 is first switched on at time t4 when the actual level Lr of the oil Lu is adequate. The recoil starter 21 is subsequently manually operated to commence startup. The crankshaft 11 begins to rotate in accordance with the startup operation. As a result, the generator 23 begins to generate power. The control unit 27 and ignition circuit 31 automatically start when power is fed from the generator 23.

The spark plug 33 begins ignition action at time t6 when the actual speed Nr of the engine 10 has increased to the first reference speed Ns1.

The spark plug 33 stops ignition action at time t7 when the actual level Lr of the oil Lu has dropped. This happens at time t7 before the actual speed Nr of the engine 10 has increased to the second reference speed Ns2. The crankshaft 11 stops when the startup operation via the recoil starter 21 has stopped, and the engine 10 stops as a result.

The actual level Lr is thereafter brought to a suitable level at time t8 by filling the crankcase 12 with oil Lu after the main switch 26 has been switched off.

The recoil starter 21 thereafter begins startup operation at time t10 after the main switch 26 has been switched on at time t9. The crankshaft 11 begins to rotate in accordance with the startup operation. As a result, the generator 23 begins to generate power. The control unit 27 and ignition circuit 31 automatically start when power is fed from the generator 23.

The spark plug 33 begins ignition action at time t11 when the actual speed Nr of the engine 10 has increased to the first reference speed Ns1.

The actual speed Nr of the engine 10 thereafter increases and reaches the second reference speed Ns2 at time t12. Therefore, at time t12 and thereafter, the spark plug 33 continues ignition action regardless of the actual level Lr of the oil Lu. The spark plug 33 then stops ignition action when the main switch 26 is switched off at time t13. The engine 10 stops as a result.

Following is a summary of the above description.

The present invention was contrived in view of the fact that the state of the surface of the oil Lu is different when the engine 10 is stopped and when the engine is operating, and the behavior of the float 43 differs accordingly. Specifically, when the engine 10 is stopped, the surface of the oil does not fluctuate, and when the engine 10 is operating, the surface of the oil fluctuates considerably.

In contrast, the control unit 27 of the present invention is configured so that the ignition circuit 31 fires the spark plug 33 using the power generated by the generator 23 via the motive force of the engine 10, and that the supply of power from the ignition circuit 31 to the spark plug 33 is controlled on the basis of two detection signals, i.e., (i) the actual speed Nr of the engine 10 detected by the engine speed sensor 22, and (ii) the drop in the oil level Lu detected by the float-type oil level sensor 25.

In other words, the control unit 27 is configured to (i) determine the operating state of the engine 10 on the basis of the detection signal of the engine speed sensor 22, (ii) determine the level Lr of the oil Lu on the basis of the detection signal of the float-type oil level sensor 25, and (iii) control the ignition circuit 31 so as to switch between feeding and stopping power to the spark plug 33 on the basis of the operating state of the engine 10 and the level Lr of the oil Lu.

For this reason, the engine 10 can be determined to be in a state "prior to startup or during startup" or "operating (running)"; i.e., the operating state of the engine 10 can be reliably detected, by detecting the actual speed Nr using the engine speed sensor 22.

The startup of the engine 10 can be prevented when the float-type oil level sensor 25 has detected that the oil level Lu has dropped when the engine 10 is in a state immediately prior to startup or is starting up. Since startup only occurs when there is sufficient oil Lu, the sliding parts of the engine 10 can be smoothly lubricated and, as a result, the durability of the engine 10 can be assured.

On the other hand, when the level Lr of the oil Lu is adequate and the engine 10 has started, the engine 10 does not need to be stopped even if the surface of the oil Lu severely and considerably fluctuates and temporarily tilts during work, because the oil Lu is sufficiently pooled in the crankcase 12. Therefore, the work efficiency of the work machine in which the engine 10 is mounted can be increased.

The engine 10 can be easily and reliably started and stopped on the basis of two detection signals, i.e., the signal indicating the actual speed Nr of the engine 10 and the signal indicating a low level of the oil Lu.

The control unit 27 is furthermore configured to control (see the details of ST13 in FIG. 4) the ignition circuit 31 so as to prevent the supply of power to the spark plug 33 when a certain condition is satisfied (see the details of ST11 and ST12 in FIG. 4); i.e., when a detection signal indicating a low oil level has been received from the float-type oil level sensor 25 at time t2 at which the startup operation of the recoil starter 21 is started, as shown by the actions taken at times t1 to t3 in FIG. 6.

The timing at which ST11 and ST12 in FIG. 4 are executed can be considered to be nearly simultaneous to the timing t2 at which the startup operation of the recoil starter 21 is started. For this reason, in the present invention, the time t2 at which the startup operation of the recoil starter 21 is started is the same as the time at which ST11 and ST12 in FIG. 4 are executed.

The crankshaft 11 is rotated by the startup operation of the recoil starter 21. As a result, the generator 23 is driven by the crankshaft 11 and is caused to start to generate power. When the oil level Lu has dropped to the lower-limit level Lm at time t2 at which power generation is started, the ignition circuit 31 stops power supply to the spark plug 33. Since the spark plug 33 does not fire as a result, the engine 10 does not operate.

In other words, the recoil starter 21 can be operated an unlimited number of times even when the level Lr of the oil Lu has dropped to the lower-limit level Lm. However, the spark plug 33 does not fire when the oil level Lu drops. The engine 10 does not operate as a result.

Therefore, the operator can determine that the level Lr of the oil Lu has fallen below the designated value Lm because the engine 10 does not start even when the startup operation of the recoil starter 21 has been repeated. Specifically, the operator can clearly know that the level Lr of the oil Lu has dropped below the designated value Lm at time t2 at which the startup operation of the recoil starter 21 is started.

An alarm device for alerting that the oil level has dropped is not required to be provided to the multipurpose engine controller 20. An increase in the number of components can be prevented and a small engine 10 can be provided.

The control unit 27 is furthermore configured to control (see the details of ST21 in FIG. 4) the ignition circuit 31 so as to stop the supply of power to the spark plug 33 when the condition is satisfied that the actual speed Nr has not reached the second reference speed Ns2 (see the details of ST17 and ST18 in FIG. 4), and when the condition is satisfied that a detection signal indicating a low oil level has been received from the float-type oil level sensor 25 (see the details of ST19 and ST20 in FIG. 4). This occurs at a time that follows the time t6 at which power supply from the ignition circuit 31 to the spark plug 33 has started (see the details of ST16 in FIG. 4), as shown by the actions taken at times t3 to t8 of FIG. 6.

For this reason, the engine 10 is in the process of starting up after the recoil starter 21 undergoes a startup operation and the supply of power from the ignition circuit 31 to the spark plug 33 has been started, but before the actual speed Nr reaches the idling speed Ns2 (second reference speed Ns2). During the startup, the ignition circuit 31 stops the supply of power to the spark plug 33 if the oil level Lu has dropped to the lower-limit level Lm. As a result, the engine 10 does not start up, because the spark plug 33 does not fire. Therefore, the operator can clearly know that the oil level Lu has dropped below the designated value Lm during startup of the engine 10.

The control unit 27 is furthermore configured to determine that the engine 10 is operating (running) and to control (see the details of ST22 in FIG. 4, i.e., the details of ST31 to ST34 in FIG. 5) the ignition circuit 31 so as to continue the supply of power to the spark plug 33 regardless of the detection signal of the float-type oil level sensor 25. This occurs when the condition is satisfied (see the details of ST17 and ST18 in FIG. 4) that the actual speed Nr detected by the engine speed sensor 22 has reached the fixed second reference speed Ns2 set in advance, as shown by the actions taken at times t8 to t13 in FIG. 6.

For this reason, when the actual speed Nr has increased and the idling speed Ns2 (second reference speed Ns2) has been reached, a determination is made that the engine 10 has completed startup, and the engine 10 can thereafter continue to be kept in a state of operation even if the surface of the oil Lu severely and considerably fluctuates and temporarily tilts.

Figure 7:
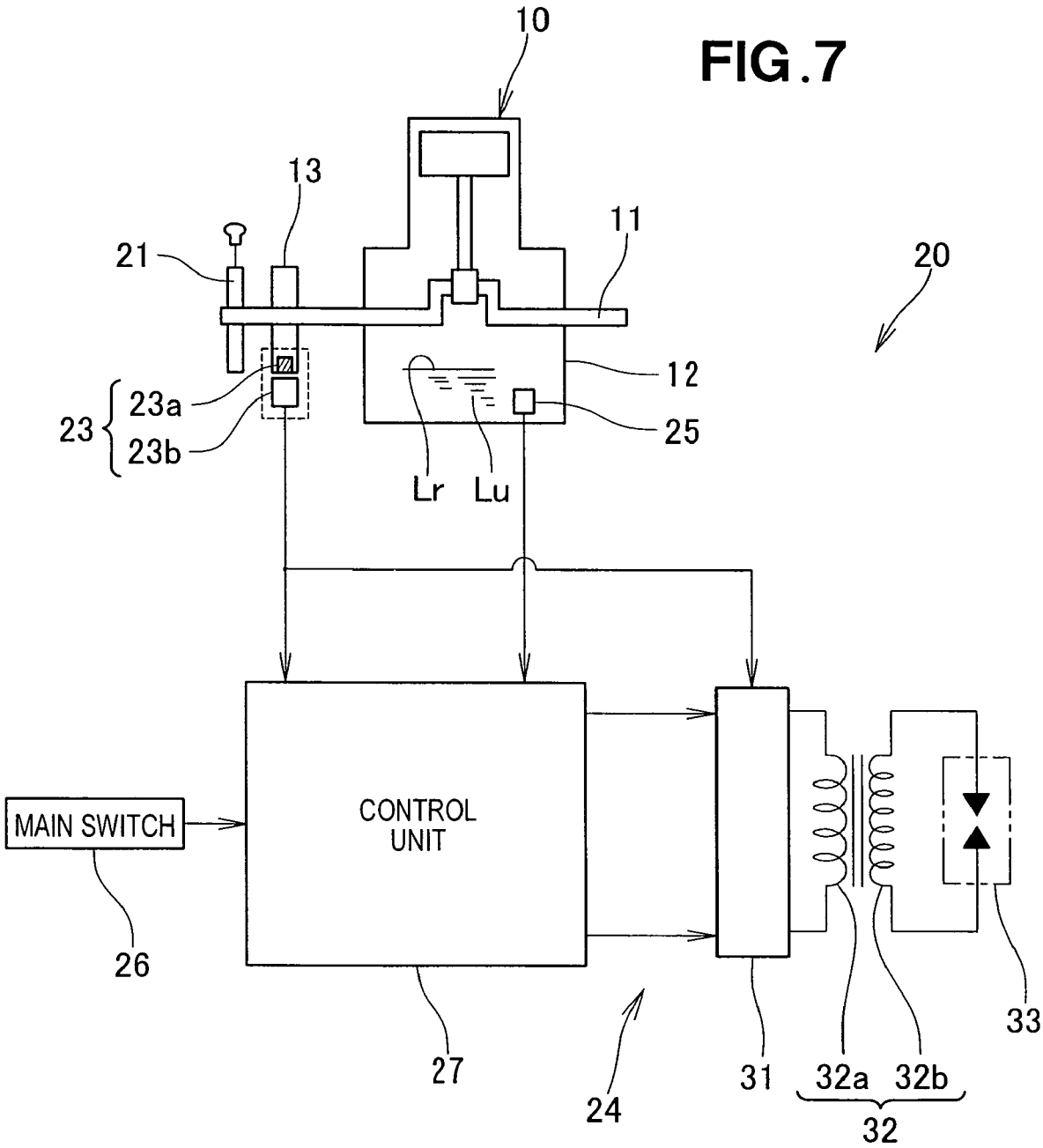
FIG. 7 is a schematic view illustrating a multipurpose engine and the multipurpose engine controller according to a modified example.

The engine speed sensor 22 is not limited to a separately disposed configuration and may be shared with other components, as shown in FIG. 7, for example. Also, the engine speed sensor 22 may be configured to indirectly detect the actual speed Nr in addition to the configuration for direct detection described above.

A modified example of the multipurpose engine controller 20 is described next with reference to FIG. 7.

The engine speed sensor of the modified example is incorporated into the generator 23, as shown in FIG. 7. For this reason, the configuration of the multipurpose engine controller 20 is simplified in comparison with the case in which the engine speed sensor 22 (see FIG. 1) is separately disposed.

The engine speed sensor of the modified example can directly or indirectly detect the actual speed Nr of the engine 10 on the basis of the signals detected by a pickup coil in the generator 23.

The pickup coil comprises a power-generating coil 23*b* or a coil disposed separately from the coil 23*b*. The pickup coil is magnetically affected by the permanent magnet 23*a* that rotates together with the crankshaft 11, and generates pulses in accordance with the actual speed Nr.

In other words, the pulse voltage and the number of pulses per unit of time, which are generated by the pickup coil, vary in accordance with the actual speed Nr. If the actual speed Nr increases, for example, the pulse voltage and the number of pulses per unit of time increase as well.

In this modified example, the control unit 27 can be configured with a capacitor charged with pulse voltage. Charging the capacitor with the pulse voltage allows the charging voltage of the capacitor to vary in accordance with the pulse voltage and the number of pulses per unit of time. The charging voltage of the capacitor is a value that corresponds to the actual speed Nr. In the control unit 27 of the modified example, the value of the charging voltage of the capacitor is substituted in place of the actual speed Nr to obtain an indirect reading.

Therefore, in the modified example, the engine speed sensor can be considered to be-configured to indirectly detect the actual speed Nr in a structure in which a pickup coil and a capacitor are used in combination. For this reason, the actual speed Nr of the engine 10 is indirectly detected in this manner in steps ST14 and ST17 shown in FIG. 4.

The pickup coil may double as the primary coil 32*a* of the ignition coil 32. In such a case, the power generated by the pickup coil is directly used as the primary power of the ignition coil 32.

In the present invention, the engine 10 may be a multipurpose engine mounted in a work machine.

The operating state of the engine 10 may be detected by the control unit 27 on the basis of a detection signal of the engine speed sensor 22. For example, the control unit 27 may determine whether the engine 10 is starting up or is operating (running), or may determine whether the engine is stopped.

The control unit 27 is not limited to a configuration principally comprising a microcomputer.

The starter for starting the engine 10 is not limited to a recoil starter 21, and a cell starter may be used.

The multipurpose engine controller 20 of the present invention performs control so as to (a) prevent the engine from starting when the oil Lu is insufficient during stoppage of the engine 10, (b) stop the engine 10 when the oil Lu is insufficient during startup of the engine 10, and (c) continue running the engine 10 when the engine 10 is running, regardless of the level Lr of the oil Lu. The present invention is therefore useful for controlling a multipurpose engine 10 mounted in a work machine, e.g., a rammer or other construction work machine, or a brush cutter or other farming equipment. These are machines in which the surface of the oil Lu severely and considerably fluctuates and temporarily tilts during work.

Obviously, various minor changes and modifications of the present invention are possible in light of the above teaching. It is therefore to be understood that within the scope of the appended claims the invention may be practiced otherwise than as specifically described.

What is claimed is:

1. A multipurpose engine controller for controlling a multipurpose engine, the controller comprising:

a power generator for generating power via a motive power of the multipurpose engine;

an ignition circuit for firing a spark plug using the power generated by the power generator;

an engine speed sensor for detecting a speed of the multipurpose engine;

a float-type oil level sensor for emitting an oil level drop detection signal when the level of the oil pooled in the crankcase of the multipurpose engine has dropped to a fixed lower-limit level; and a control unit for controlling the ignition circuit, so as to supply and stop power to the spark plug on the basis of the operating state of the multipurpose engine and the state of the level of the oil, wherein the spark plug is ignited after the oil level has been suitable, and a determination has been made as to confirm that the speed of the multipurpose engine has reached a first reference speed set in advance.

2. The controller of claim 1, wherein the control unit determines that the multipurpose engine is in a stable operating state when a condition has been satisfied that the speed of the multipurpose engine has reached a constant second reference speed, and controls the ignition circuit so that power supply to the spark plug is continued regardless of the state of the level of the oil, wherein the second reference speed is a value larger than the first reference speed.

3. The controller of claim 2, wherein the multipurpose engine comprises a starter, and the control unit controls the ignition circuit so as to prevent power from being supplied to the spark plug when a condition has been satisfied that the oil level drop detection signal has been received at a point at which the startup operation of the starter begins.

4. The controller of claim 3, wherein the control unit controls the ignition circuit so as to stop power from being supplied to the spark plug when, after power supply to the spark plug has started, a condition is satisfied that the speed of the multipurpose engine has not reached said constant second reference speed, and a condition is satisfied that the oil level drop detection signal has been received.

* * * * *